United States Patent [19]

Skjelby

[11] 4,206,867

[45] Jun. 10, 1980

[54] CONTAINER AND BLANK FOR CONSTRUCTING SAME

[75] Inventor: Finn Skjelby, Spikkestad, Norway

[73] Assignee: Ex-Cell-O Corporation, Troy, Mich.

[21] Appl. No.: 972,191

[22] Filed: Dec. 21, 1978

[51] Int. Cl.[2] ..... B65D 5/74

[52] U.S. Cl. ..... 229/17 G; 229/DIG. 4

[58] Field of Search ..... 229/17 R, 17 G, DIG. 4; 93/44.1 GT

[56] References Cited

U.S. PATENT DOCUMENTS

| | | | |
|---|---|---|---|
| 3,120,335 | 2/1964 | Egleston et al. | 229/17 G |
| 3,471,076 | 10/1969 | Crawford | 229/17 G |
| 3,869,078 | 3/1975 | Braun | 229/17 G |
| 4,078,715 | 3/1978 | Larsson et al. | 229/17 R |
| 4,093,115 | 6/1978 | Bachner et al. | 229/17G |
| 4,124,159 | 11/1978 | Schwartzkopf | 229/17 G |

*Primary Examiner*—Davis T. Moorhead

*Attorney, Agent, or Firm*—John P. Moran

[57] ABSTRACT

A coated paperboard container and a blank for constructing the container are disclosed as including a body portion having an upper end that is closed by a folded top end closure which includes closure panels having a construction that enhances foldability and sealing. Front and back gable panels of the top end closure are each flanked by a pair of triangular inner roof panels that have different sizes than each other so as to facilitate folding of the sealed top end closure from a vertical position in a direction toward the smaller inner roof panels. The unequal size of the inner roof panels on opposite sides of each gable panel is provided by score line portions that are stepped with respect to one another. The lower of the adjacent score line portions, providing the smaller inner roof panel is formed wider than the other score lines so as to allow the top seal to be sealed in a vertical position and then to be readily folded toward the smaller inner roof panels.

8 Claims, 10 Drawing Figures

CONTAINER AND BLANK FOR CONSTRUCTING SAME

TECHNICAL FIELD

The invention relates generally to a coated paperboard container and, more particularly, to a blank for construction the container so as to include a body portion having a top end closed by a folded top end closure of an improved construction.

BACKGROUND ART

Containers for beverages such as milk, cream, other dairy products, juices, and the like are conventionally constructed from thermoplastic coated paperboard. One type of these containers includes a top end closure with a folded gable roof having a vertically projecting seal at the roof ridge for sealing the container and providing a pouring spout when the contents of the container are to be dispensed. Stacking of such containers requires the use of separating trays intermediate different layers due to the vertically projecting seals of their top end closures. Also storage space is lost in stacking these containers due to the empty space resulting from the configuration of the top end closure. Such containers are shown by U.S. Pat. Nos. 3,116,002 and 3,120,335. Another type of container includes flat top end closures that are folded and have a flat seal projecting from a centerline of the closure with an outer end that is releasably secured to the rest of the closure generally adjacent one of its sides. Various releasable securements are provided for releasing the flat seals to permit them to be opened and to thereby provide a pouring spout for dispensing the beverages. U.S. Pat. Nos. 3,869,078 and 3,892,347 disclose such flat top end closures. A further type of container is disclosed by United States Published Patent No. 4,078,715, issued Mar. 14, 1978, and includes a top end closure with an inclined seal that includes a "harder crease" on one side of the seal for facilitating folding of the seal from a vertical position to the inclined position.

U.S. Pat. Nos. 4,012,997 and 4,093,115 disclose a container folding method and the container made by the method wherein certain roof panels of the top end closure are provided with double score lines extending alongside each other. Folding of a top seal of the end closure from a vertical position to a flat position requires the application of a downward force along the lower double score line on one side of the top seal and the application of another force to bend the top seal downwardly. Each additional application of force for folding the top end closure requires an additional folding tool on the folding mechanism.

Coated paperboard blanks for constructing each type of container described above are made on converting machines like those disclosed by U.S. Pat. Nos. 2,682,208 and 3,731,600. After construction of the blanks to form the containers, application of heat or high frequency vibration, applied by clamping pressure to interengaged portions of the blanks, provides sealing of the containers.

A conventional "abhesive" coating applied to the outer seal lips and the front inner seal lip prevents complete bonding therebetween so as to facilitate opening of the pouring spout. An "abhesive" coating is a term used by those who work in the container art to describe any suitable material, such as a wax based material, that prevents sealing between different portions of the container. Front portions of the outer seal lips and the front inner seal lip cooperate with the front gable panel and the inner roof panels connected thereto to define the pouring spout used to dispense the contents of the container.

DISCLOSURE OF THE INVENTION

An object of the present invention is to provide an improved coated paperboard container and a blank for constructing the container to include a top end closure comprised of a folded roof and a top seal for sealing the roof, and wherein the construction of the top end closure enhances foldability of the top seal from a vertical position.

Another object of the invention is to provide a blank from which the container is constructed, wherein the blank includes a pair of triangular gable panels whose opposite sides are connected to a pair of triangular inner roof panels that are of a different size than each other. An inner seal lip associated with each pair of inner roof panels is connected thereto by an associated single score line. A pair of outer roof panels of the top end closure are likewise connected to associated outer seal lips by associated single score lines. After sealing by heat or high frequency vibration bonding, folding of the top seal, which is defined by the inner and outer seal lips, is facilitated in a direction toward the smaller inner roof panels so as to enable the top closure to be constructed into a slant top closure or a flat top closure. The closure can also be constructed as a straight up closure without any folding of the top seal.

A further object of the invention is to provide a blank for constructing a container in accordance with the present invention which includes a single score line, formed a predetermined amount wider than the other score lines, connecting one of the outer seal panels and the associated outer roof panel at a lower elevation than the apices of the front and back gable panels, and each single score line between the inner seal lips and the associated pair of inner roof panels thereof is formed as a continuation of the single, wider score line so as to intersect the respective front and back gable panels at points below the apices thereof. The inner roof panels on one side of the top seal of the constructed end closure are thus of a smaller size than the inner roof panels on the other side of the top seal. Sealing of the top seal is performed with the inner and outer seal lips located in a generally vertical position. Each of the score line portions between the smaller triangular inner roof panels and their associated inner seal lips, and the dropped score line between the one outer seal lip and its associated outer roof panel, being wider than the other score lines of the top end closure, facilitates folding of the top seal from the vertical position to either an inclined position for providing a slant top, or a horizontal position where the top seal is adhesively bonded to the adjacent outer roof panel to provide a flat top end closure. Regardless of whether the top seal is used to make a vertical top, a slant top, or a flat top end closure, the terminal edges of the outer seal lips extend alongside each other, and the folded inner seal lips have their terminal edges parallel to one another in a stepped configuration, the score line defining the edge of the larger triangular inner roof panel being located above the score line defining the edge of the smaller triangular inner roof panel.

Other objects and advantages of the invention will become more apparent when reference is made to the following description and accompanying drawings.

BEST MODE OF CARRYING OUT THE INVENTION

Figure 1:
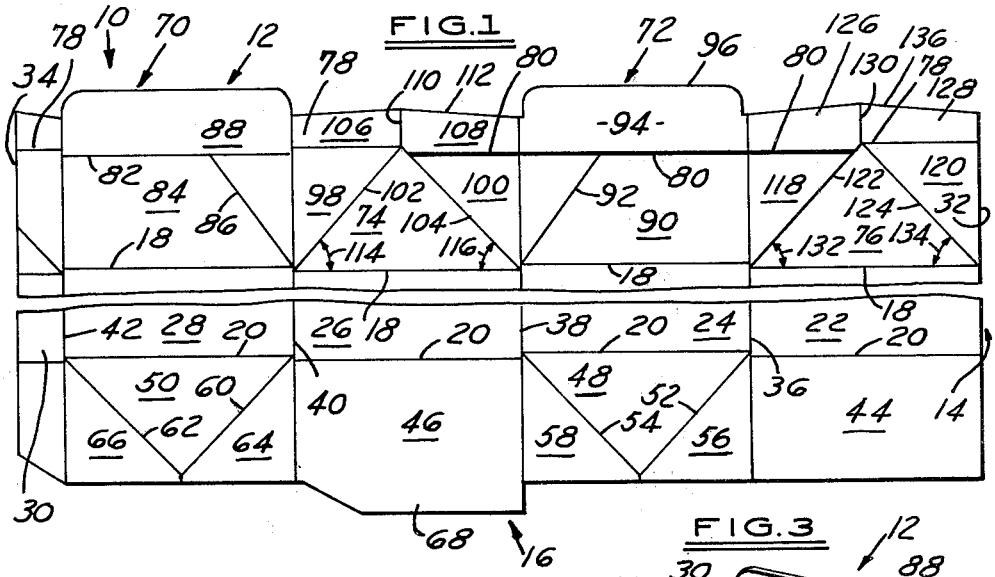
FIG. 1 is a broken layout view of a coated paperboard container blank used to construct a container having a top end closure with a roof and a top seal arrangement in accordance with the present invention.

Referring now to the drawings in greater detail, FIG. 1 illustrates a container blank 10 formed in accordance with the principles of the present invention. The container blank 10 is generally divided into three sections including a flat top end closure 12, a body portion 14, and a flat bottom end closure 16. A staggered lower top horizontal score line 18 extends transversely across the container blank 10 and separates the flat top end closure 12 and the body portion 14. A bottom staggered horizontal score line 20 extends transversely across the container blank 10 and separates the flat bottom end closure 16 and the body portion 14. The body portion 14 comprises a plurality of integrally connected body panels 22, 24, 26 and 28, and a side seam flap 30. The container blank 10 is defined on its longitudinal sides by its edges 32 and 34. The body panels 22, 24, 26 and 28, and the side seam flap 30, are defined by vertical score lines 36, 38, 40 and 42.

The flat bottom end closure 16 has a pair of external closure panels 44 and 46 which are integral with and extend longitudinally from the body panels 22 and 26, respectively. A pair of triangular closure panels 48 and 50 are an integral part of the flat bottom end closure 16, and they extend longitudinally from the body panels 24 and 28, respectively. The triangular closure panel 48 is defined by the transverse score line 20 and bottom diagonal score lines 52 and 54. The triangular closure panel 48 is integrally connected to the external closure panels 44 and 46 by a pair of integral fold back panels 56 and 58, respectively. The triangular closure panel 50 is defined by the horizontal score line 20 and a pair of bottom diagonal score lines 60 and 62. A pair of integral fold back panels 64 and 66 integrally connect the triangular closure panel 50 to the external closure panel 46 and the side seam flat 30, respectively. As is set forth in more detail hereinafter, the side seam flap 30 is connected to the external full closure panel 44 so as to place the fold back panel 66 adjacent to the external closure panel 44 in a constructed or erected container. As shown in FIG. 1, the external closure panel 44 is not provided with any tuck-in flap, but the external closure panel 46 is provided with an integral overlap flap 68. The details of the bottom end closure 16 are discussed in detail in U.S. Pat. No. 3,498,524 issued on Mar. 3, 1970, and U.S. Pat. No. 3,120,335 issued on Feb. 4, 1964, and these patents are incorporated herein by reference.

The flat top end closure 12 comprises an outer roof panel 70 and an inner roof panel 72. The panels 70 and 72 are connected integrally to the upper ends of the body panel members 28 and 24, respectively. A triangular spout panel 74 and a triangular closure panel 76 are connected integrally to the body panels 26 and 22, respectively. A staggered upper top horizontal score line, consisting of portions 78, 80 and 82, extends transversely from the blank edge 32 to the blank edge 34, substantially parallel to the horizontal score lines 18 and 20. As will be explained in greater detail later, the score line portion 80 is wider than the other score line portions.

The outer roof panel 70 is divided basically into two portions by the horizontal score line 82. A lower closure panel portion 84 is defined by the score lines 40, 42, 82 and 18. An opening assist score line 86 extends substantially from the intersection of the score line 18 and the score line 40 to a point on the score line 82 that is closer to the score line 40 than to the score line 42. An upper closure panel portion 88 of the outer roof panel 70 serves as a sealing panel, as will be explained.

The inner roof panel 72 is divided into two parts by a portion of the wide score line 80. The inner part of the roof panel 72 comprises a lower closure panel 90 which is defined by the horizontal score lines 80 and 18 and the vertical score lines 36 and 38. An opening assist score line 92 extends from the intersection of score lines 18 and 38 to a point on the wide score line 80. The last mentioned intersection on the score line 80 is closer to the score line 38 than the score line 36, and it is substantially the same distance from the score line 38 as the opening assist score line 86 is from the score line 40 along the score line 82. The inner roof panel 72 includes an upper closure panel 94 which is integral with the closure panel 90, and it is separated therefrom by the wide score line 80. The upper outer edge 96 of the closure panel 94 is perpendicular to extensions of the vertical score lines 36 and 38.

The triangular spout panel 74 is connected to a pair of fold back panels 98 and 100 by diagonal score lines 102 and 104, respectively. The fold back panels 98 and 100 connect the triangular spout panel 74 to the closure panels 84 and 90, respectively. A pair of pouring panels or infold lips 106 and 108 are integrally connected to the fold back panels 98 and 100, respectively, and they are defined by portions of the horizontal score lines 78 and 80, respectively, the vertical score lines 40 and 38, and a vertical gable score line 110. As shown in FIG. 1, the upper outer edge of the triangular spout panel 74 is formed with an inverted, V-shaped edge 112. The numerals 114 and 116 designate the triangular base angles formed between the diagonal score lines 102 and 104, respectively, and the horizontal score line 18. The triangular base angles 114 and 116 are formed so as to be equal.

The triangular closure panel 76 is integrally connected to a pair of fold back panels 118 and 120 by diagonal score lines 122 and 124, respectively. The fold back panel 118 integrally connects the triangular closure panel 76 to the closure panel 90. A pair of closure panels or infold lips 126 and 128 are connected to the fold back panels 118 and 120, respectively, and they are defined at their lower ends by portions of the score lines 80 and 78, respectively, and at their outer edges by the score line 36 and the edge 32. The closure panels 126 and 128 are separated from each other by a vertical gable score 130.

The triangular base angles formed by the lower ends of the diagonal score lines 122 and 124 and the horizontal score line 18 are indicated by the numerals 132 and 134, respectively, and in the illustrated embodiment of FIG. 1, these angles are equal to each other, and the same as the base angles 114 and 116. The upper outer edge 136 of the closure panel 76 is formed as an inverted V-shaped edge.

As illustrated in FIG. 1, the score line portion 80, extending between the diagonal score lines 104 and 122, offset from the respective vertical score lines 110 and 130, is a wide, straight score line, dropped a predetermined distance from the adjacent score line portions 78, and aligned with the score line portion 82. As such, the adjacent triangular inner roof panels 100 and 118 are smaller than the respective inner roof panels 98 and 120. This difference in size, in conjunction with the weakening effect of the widened score line 80, enhances the foldability of the top end closure.

Figure 2:
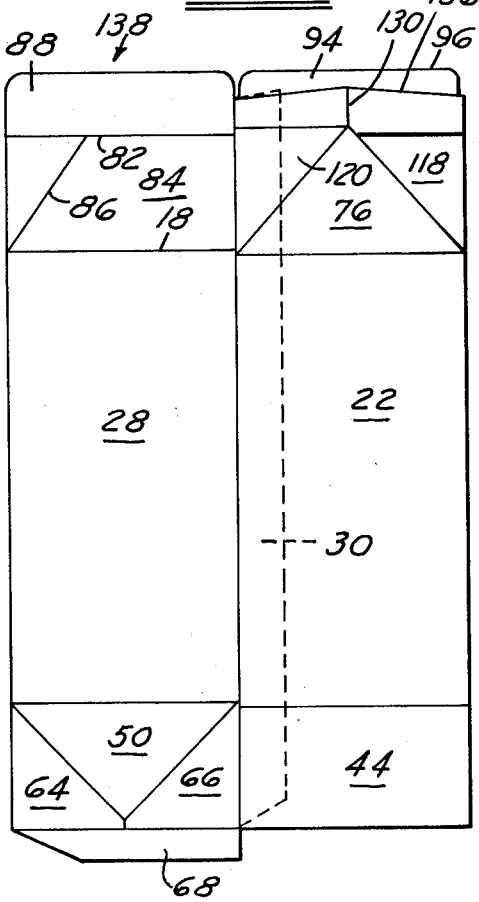
FIG. 2 is a layout view of the outside surface of a tab top container structure after it is side seamed from the tab top container blank illustrated in FIG. 1.

The container blank 10 illustrated in FIG. 1 is formed into a side seam blank as illustrated in FIG. 2, and as designated by the numeral 138. The side seam blank 138 is formed by rotating the body panel 28 and the side seam flap 30 as a unit about the vertical score line 40, and having the inside surfaces of the body panel 28 come into contact with the inside surface of the body panel 26, with the vertical score line 42 positioned next to the vertical score line 38, and with the inside surface of the side seam flap 30 contacting the inside surface of the body panel 24 adjacent the vertical score line 38. The body panel 22 is then rotated about the vertical score line 36 to bring its inside surface into contact with the inside surface of the body panel 24. The inside surface of the body panel 22 along the edge 32 comes into contact with the outside surface of the side seam flap 30, and the edge 32 is positioned parallel and aligned with the vertical score line 42. The various members of the flat top end closure 14 and the bottom end closure 16 will make similar movements, and the container will appear as illustrated in FIG. 2. The container blank 10 is then side seamed where the inside area of the body panel 22 comes into contact with the outside surface of the side seam flap 30.

Figure 3:
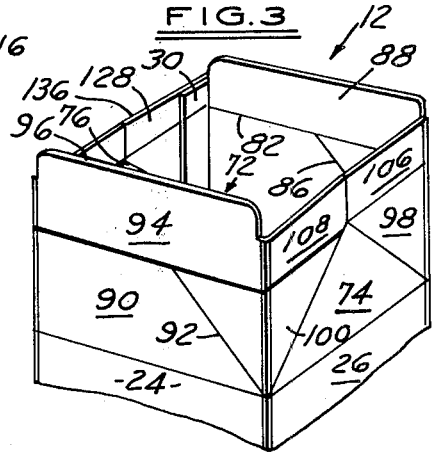
FIG. 3 is a fragmentary perspective view showing the side seamed tab top container blank illustrated in FIG. 2 in an open ended top end view prior to the closing of the flat top end closure structure of the present invention.

The next step in forming the side seamed blank 136 into a container is illustrated in FIG. 3. FIG. 3 illustrates how the side seam blank 136 is opened up into a squared condition, after which the flat bottom end closure 16 is formed in a manner well known in the container art, and disclosed in detail in the above cited prior art patents. Generally, in the forming of the flat bottom end closure 16, the triangular closure panels 48 and 50 are moved about the horizontal score line 20 toward the middle of the container. The fold back panels 56/58 and 64/66 rotate about the diagonal score lines 52/54 and 60/62, respectively, with their outside surfaces contacting the outside surfaces of the triangular closure panels 48 and 50. At the same time, the external closure panels 44 and 46 are moving towards each other. The various portions of the flat bottom end closure 16 are then sealed, either by heat or high frequency vibration techniques, to form a liquid tight flat bottom end closure structure.

After the bottom end closure 16 is formed, as described above, and a product has been inserted in the container, the various parts of the top end closure 12 are folded about the various score lines in the following manner so as to form the top end structure 12. The triangular spout panel 74 is moved around the horizontal score line 18 over the end of the filled container and towards its center. At the same time, the triangular closure panel 76 is moved toward the middle of the filled container about the horizontal score line 18.

The outside surfaces of the pouring panels 106 and 108 will be rotated towards each other about the vertical score line 110, and the closure panels 126 and 128 will have their outside surfaces rotated towards each other about the vertical score line 130. The inside surfaces of the pouring panel 108 and the closure panel 126 will come into contact with the sealing panel 96. The inside surface of the pouring panel 106 and closure panel 128 will come into contact with the sealing panel 84.

Figure 4:
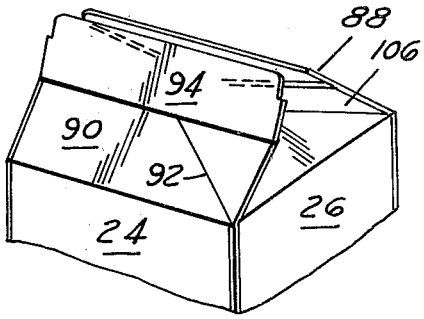
FIG. 4 is a fragmentary perspective view, similar to FIG. 3, and showing the tab top container blank of FIG. 3 in a partially closed condition.

As viewed in FIG. 4, the last mentioned top closure elements come to a position at an angle to the top end of the body portion 14. The sealing of the last mentioned elements of the top closure 14 is preferably accomplished by a sonic or high frequency vibration sealing means, because such a seal gives a liquid tight seal, and yet is easily opened. The sealing of these various top end closure elements may also be accomplished by other means, such as gas heat, if desired.

Figure 5:
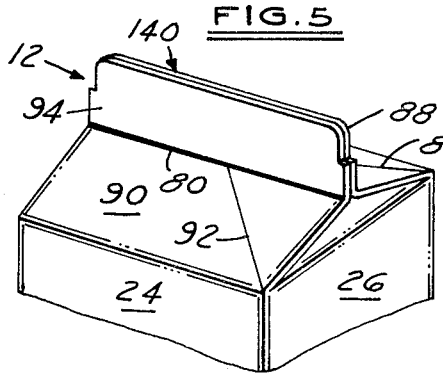
FIG. 5 is a fragmentary perspective view showing the tab top container blank of FIGS. 3 and 4 with the sealing panels in vertical position to permit sonic sealing of the central area of the container top end closure structure to provide a liquid proof seal for the container.

FIG. 5 illustrates the positions of the various elements of the top end closure 12 once the sealing of the top end closure 12 has been effected, i.e., with the sealing panels 94 and 86 being disposed in a position perpendicular to a plane perpendicular to the side panels 22, 24, 26 and 28 to form a top seal 140. The filled container can be utilized in this manner, comparable to a conventional straight up vertical gable top, but with a shorter gable height relative thereto.

Figure 6:
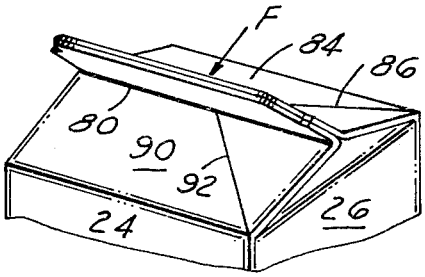
FIG. 6 is a fragmentary perspective view showing the container after the top seal has been bent from the vertical position of FIG. 5 to the inclined position shown in order to provide a slant top container.

Alternately, the top seal 132 may be moved to an inclined position by the application of a force F, as shown in FIG. 6, in order to provide a, so-called, slant top container. As indicated above, folding of the top seal 132 to the slant top position shown in FIG. 6 is facilitated by the wider dropped score line 80 and the smaller triangular inner roof panels 100 and 118. The top seal 132 extends toward the smaller inner roof panels 100 and 118 which are partially defined by the extensions of the wide score line 80 past the respective vertical score lines 38 and 36, respectively.

Figure 7:
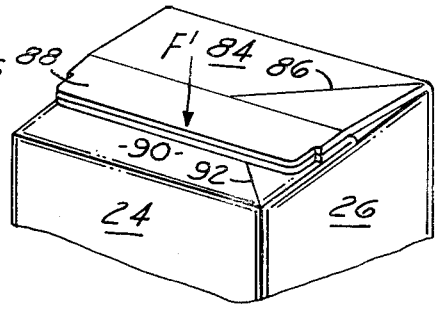
FIG. 7 is a fragmentary perspective view showing the tab top container blank illustrated in FIGS. 3, 4 and 5 after the central area of the top end closure structure has been sonically sealed, and the hold down tab has been sealed to the outer surface of the inner roof panel to provide a flat top end liquid proof container.

The versatility of the container blank 10 shown in FIG. 1 is further demonstrated by FIG. 7 wherein the top seal 132 is shown folded over to a horizontal position in order to provide a flat top end closure. The application of a force F', by use of a suitable tool, serves to further move the top seal into contact with the side of the container on which the dropped and wide score line 80 is located. The upper closure panel 94 is then releasably secured to the outer roof panel 90 by a suitable adhesive bond provided in any conventional manner in order to provide the flat top closure.

Figure 8:
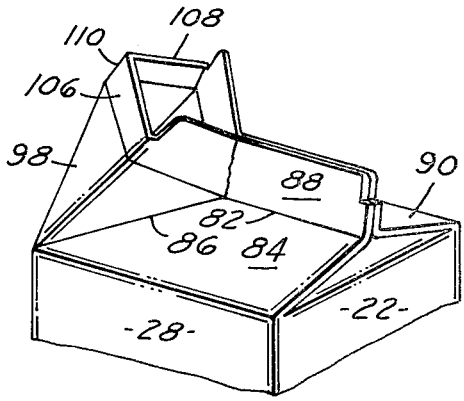
FIG. 8 is a fragmentary perspective view showing the container of FIG. 7 turned around, after the seal of FIG. 7 is broken, and with the container in its open position to form a pouring spout.
Figure 9:
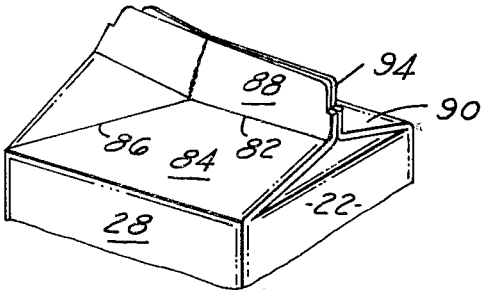
FIG. 9 is a fragmentary perspective view showing the container of FIG. 9 after the pouring spout has been moved to the closed position to reclose the container.

Opening of the constructed flat top end closure is effectuated by first releasing the top seal 132 from the outer roof panel 90, and then moving the top seal to either the slant position of FIG. 6 or the vertical position of FIG. 5 followed by opening of the pouring spout in the well known manner, to the position shown in FIG. 8. The front gable panel 74 and its connected inner roof panels 98 and 100 cooperate with the spout portions of the outer roof panels 84 and 90 to provide the pouring spout that is used to dispense the contents of the container. The container may then be reclosed after which the top seal 132 will assume an attitude similar to that shown in FIG. 9.

Figure 10:
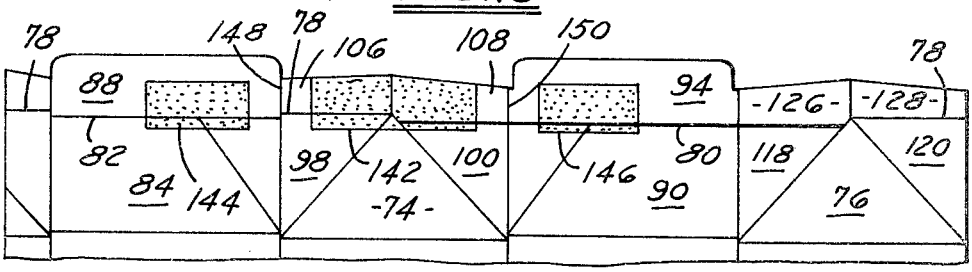
FIG. 10 is a partial layout view of the inside surface of a tab top container blank similar to the container blank shown in FIG. 1, and illustrating an abhesive pattern on the pouring panels of the pouring spout.

The upper closure panels 88 and 90, which are secured to each other as shown in FIG. 5 by the above mentioned application of either high frequency vibration or heat techniques, are prevented from forming a complete seal with the inner seal lip associated with the front triangular gable panel 74 by coating of an abhesive material applied to the infold lips 106 and 108 and portions of panels 98, 74 and 100, as shown at 142, and to the closure panels 88 and 94, as shown at 144 and 146, respectively. This abhesive coating may be made of any suitable material, such as a wax based material, and permits the sealed top end closure to be more easily opened from its closed conditions of FIGS. 5, 6 or 7 to its open condition of FIG. 8 where the pouring spout is provided. It should also be noted in FIG. 10 that the abhesive material coatings 142, 144 and 146 terminate short of the front inner seal lip ends 148 and 150 to ensure the formation of a liquid tight seal.

INDUSTRIAL APPLICABILITY

It should be apparent that slant top containers like the container shown in FIG. 6 can be packed in layers on top of each other to minimize the storage and cargo space necessary. As the containers are stacked, their slant top seals will deflect downwardly. As this deflection takes place, the slant top end closure provides an inherent cushioning effect between the layers of containers to enhance the transportability of the containers without leakage occurring. Unlike folded gable roof closures with vertically projecting seals (FIG. 5), this container does not require any shipping tray intermediate the different layers of stacked containers. These advantages are also apparent with respect to flat top end closures, as shown in FIG. 7.

It should be further apparent that the construction embodying the wider score line on one side of the top end closure enhances the foldability of the top seal toward the smaller inner roof panels into either a slant top or a flat top container.

While but one embodiment of the invention has been shown and described, other modifications thereof are possible.

What is claimed is:

1. A blank (10) for constructing a container adaptable to being folded into a "slant top" container or a "flat top" container, the blank comprising: body panels including front (26) and back (22) panels and a pair of side panels (24,28), one (24) of which joins the front and back panels; bottom end closure panels (44,46,48,50) connected to lower ends of the body portion panels; top end closure panels connected to upper ends of the body portion panels; said top end closure panels including front (74) and back (76) (gable) triangular panels respectively connected to the top ends of the front and back panels of the body portion and also including a pair of lower closure panels (84,90) respectively connected to the top ends of the side panels of the body portion; a pair of fold back panels (98/100,118/120) panels located on opposite sides of each triangular panel; a pair of upper closure panels (88,94) respectively connected via horizontal score lines (82,80) to the lower closure panels; and a pair of single panel infold lips (106/108,126/128) respectively connected via respective single score line portions (78,80) to respective pairs of fold back panels, the single score line portion (80) between one of each (108,126) of said pairs of single panel infold lips and the adjacent fold back panels (100,118) being located lower than and parallel to the single score line portion (78) between the other of each of said pairs of single panel infold lips (106, 128) and the other pair of fold back panels, thereby causing said foldback panels to be of different sizes, enhancing the foldability of the upper closure panels toward the side bearing the lower score lines.

2. The blank described in claim 1, wherein said lower single score line portions (80) are wider than the adjacent parallel score line portions (78), further enhancing the foldability of the upper closure panels.

3. The blank described in claim 2, wherein one of the (aligned) horizontal score lines between the upper closure panels and the lower closure panels is a wide score line (80) interconnecting and aligned with said wider, lower single score line portions (80).

4. The blank described in claim 1, wherein said upper closure panel intermediate said lower single score line portions is adapted to fold along the adjacent horizontal score line so as to assume a position parallel to and flush against said adjacent lower closure panel in the flat top configuration.

5. A flat top container comprising body panels including front and back panels and a pair of side panels, one of said side panels being integrally connected by respective vertical score lines to the front and back panels; bottom end closure panels connected to lower ends of the body portion panels; top end closure panels connected to upper ends of the body portion panels; said top end closure panels including front and back triangular panels respectively connected to the top ends of the front and back panels of the body portion and also including a pair of lower closure panels respectively connected to the top ends of the side panels of the body portion; a pair of fold back panels located on opposite sides of each triangular panel; a pair of upper closure panels respectively connected via horizontal score lines to said lower closure panels and adapted to extend vertically therefrom prior to being folded into a flat top configuration; and a pair of infold lips respectively connected via respective single score line portions to said fold back panels and sealed between said pair of upper closure panels, the single score line portion between one of each of said pairs of infold lips and the adjacent fold back panel being located lower than and substantially parallel to the single score line portion between the other of each of said pairs of infold lips and the other fold back panel, one of said horizontal score lines being aligned with and extending across said one of said side panels to interconnect said single score line portions, said adjacent upper closure panel being folded along said interconnecting horizontal score line from said vertical position to a position of lying flat against the adjacent lower closure panel.

6. The flat top container described in claim 5, wherein said lower score line portions and said one of said horizontal score lines are wider than the remaining score lines, enhancing the foldability therealong of said one of each of said pairs of infold lips and said adjacent upper closure panel.

7. A slant top container comprising body panels including front and back panels and a pair of side panels, one of said side panels being integrally connected by vertical score lines to the front and back panels; bottom end closure panels connected to lower ends of the body portion panels; top end closure panels connected to upper ends of the body portion panels; said top end closure panels including front and back triangular panels respectively connected to the top ends of the front and back panels of the body portion and also including a pair of lower closure panels respectively connected to the top ends of the side panels of the body portion; a pair of fold back panels located on opposite sides of each triangular panel; a pair of upper closure panels respectively connected via horizontal score lines to said lower closure panels and adapted to extend vertically therefrom prior to being folded into a slant top configuration; and a pair of infold lips respectively connected via respective single score line portion to said fold back panels, the single score line portion between one of each of said pairs of infold lips and the adjacent fold back panel being located lower than and substantially parallel to the single score line portion between the other of each of said pairs of infold lips and the other fold back panel, one of said horizontal score lines being aligned with and extending across said one of said side panels to interconnect said single score line portions, said adjacent upper closure panel intersecting said adjacent lower closure panel at said interconnecting horizontal score line at an angle less than that between the other upper closure panel and the other lower closure panel.

8. The slant top container described in claim 7, wherein said lower score line portions and said one of said horizontal score lines are wider than the remaining score lines, enhancing the foldability therealong of said one of each of said pairs of infold lips and said adjacent upper closure panel.

* * * * *